US006547244B2

(12) United States Patent
Connelly

(10) Patent No.: US 6,547,244 B2
(45) Date of Patent: Apr. 15, 2003

(54) GAME BOARD APPARATUS FOR USE BY THE SIGHT-IMPAIRED

(76) Inventor: Danielle Connelly, 100 Covewood St., Marco Island, FL (US) 34145

( * ) Notice: Subject to any disclaimer, the term of this patent is extended or adjusted under 35 U.S.C. 154(b) by 0 days.

(21) Appl. No.: 09/939,291

(22) Filed: Aug. 24, 2001

(65) Prior Publication Data

US 2002/0030322 A1 Mar. 14, 2002

Related U.S. Application Data

(60) Provisional application No. 60/227,993, filed on Aug. 25, 2000.

(51) Int. Cl.[7] ..... A63F 3/00
(52) U.S. Cl. ..... 273/242; 273/440; 273/DIG. 27
(58) Field of Search ..... 273/242, 243, 273/248, 287, 440, DIG. 27

(56) References Cited

U.S. PATENT DOCUMENTS

| | | | | |
|---|---|---|---|---|
| 2,464,146 | A | * | 3/1949 | Mohler |
| 3,746,343 | A | | 7/1973 | Shapiro |
| 4,027,405 | A | | 6/1977 | Schloss |
| 4,455,025 | A | | 6/1984 | Itkis |
| 4,461,483 | A | | 7/1984 | Kopp |
| 4,733,864 | A | * | 3/1988 | Casteel |
| 4,961,581 | A | * | 10/1990 | Barnes |
| 5,152,690 | A | * | 10/1992 | Todd |
| 5,249,808 | A | * | 10/1993 | Batte |
| 5,275,567 | A | * | 1/1994 | Whitfield |
| 5,429,507 | A | | 7/1995 | Kaplan |
| 5,445,390 | A | * | 8/1995 | Dutton |
| 5,511,793 | A | | 4/1996 | Watt |
| 5,895,044 | A | | 4/1999 | Bahramian |
| 6,162,059 | A | | 12/2000 | Murphy et al. |
| 6,267,374 | B1 | * | 7/2001 | Bourbeau |

FOREIGN PATENT DOCUMENTS

| | | | |
|---|---|---|---|
| EP | 0642815 A1 | * | 3/1995 |
| GB | 2203657 A | * | 10/1988 |

* cited by examiner

*Primary Examiner*—Benjamin H. Layno
*Assistant Examiner*—V K Mendiratta
(74) *Attorney, Agent, or Firm*—Laura G. Barrow

(57) ABSTRACT

A game assembly suitable for simultaneous play by both sighted and sight-impaired individuals.

10 Claims, 1 Drawing Sheet

GAME BOARD APPARATUS FOR USE BY THE SIGHT-IMPAIRED

SUMMARY OF THE INVENTION

This is application claims the benefit of the filing of co-pending U.S. provisional application Serial No. 60/227,993, filed Aug. 25, 2000, and which is incorporated by reference herein in its entirety.

The present invention is directed to games, and in particular to a game assembly comprising a game board having raised indicia that enables sight-impaired individuals to play the game along with sighted individuals.

BRIEF DESCRIPTION OF THE FIGURES

The FIGURE shows a top view of one embodiment of the inventive game assembly, including dice and game pieces.

DETAILED DESCRIPTION OF THE PREFERRED EMBODIMENT

Figure 1:
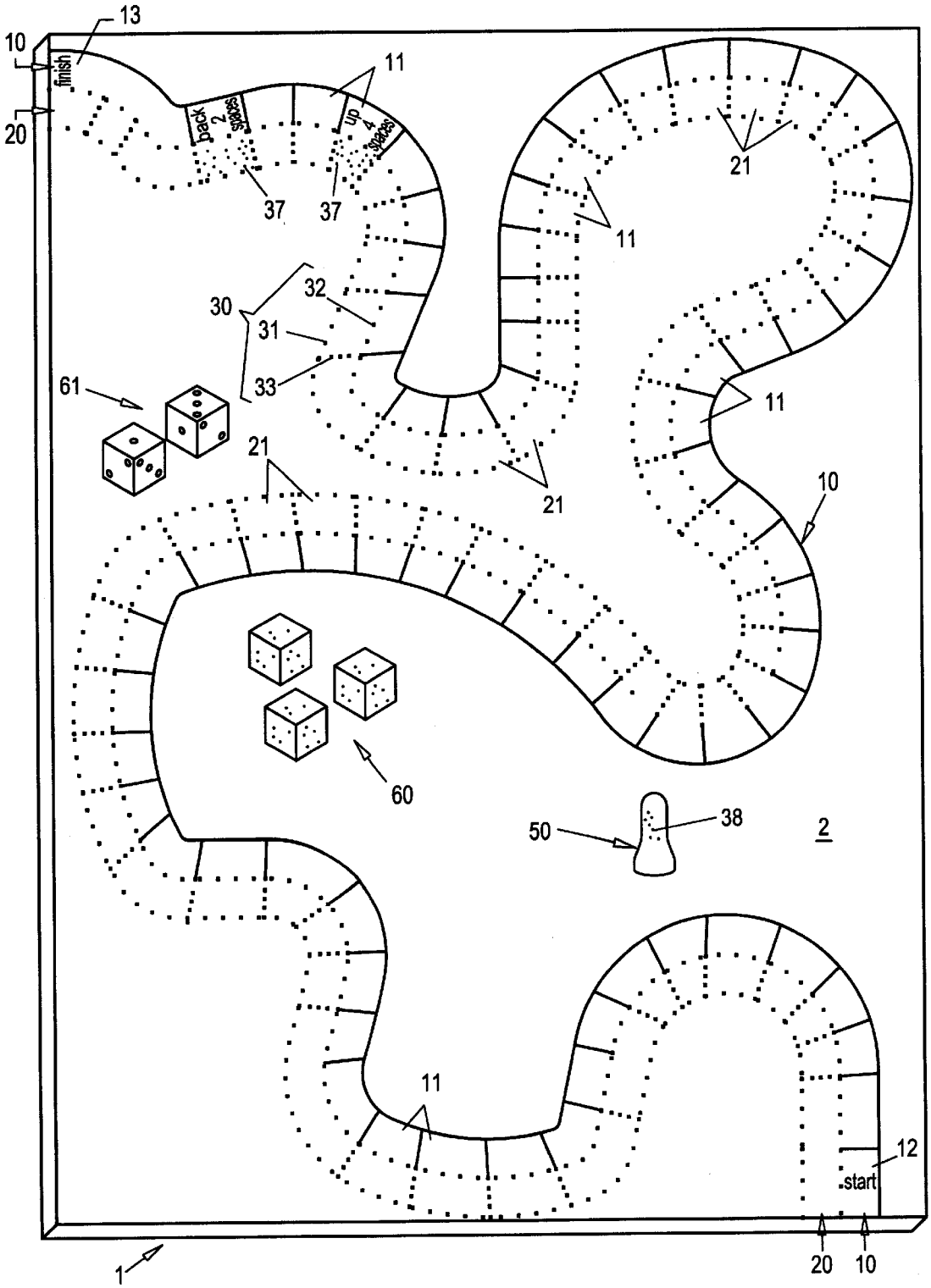

Referring now to the FIGURE, the present invention, in certain aspects, comprises a game assembly comprising a game board 1 and at least one game piece 50. Imprinted on the upper surface 2 of the game board is a first elongated path 10 divided into a plurality of segments 11 upon which the game piece 50 may be placed and moved. The first path preferably has at one end a "start" segment 12 and a "finish" segment 13 as shown. The first path is designed for play by sighted persons, and thus any indicia (i.e. text or illustrations) necessary for the play of a particular game are simply printed on the first path.

Adjacent to the first elongated path 10 is a second elongated path 20 which is also divided into a plurality of segments 21 upon which the game pieces 50 may be placed and moved thereon. As shown, the second path is positioned parallel and adjacent to the first path such that each of the path segments 21 of the second path 20 are adjacent to one of the segments 11 of the first path 10. The second path is designed for simultaneous play by sight-impaired individuals. Thus, in certain embodiments, at least one of the segments of the second path 20 has imprinted thereon raised indicia 37 (e.g. Braille) that can be tactilely read by the sight-impaired player. Preferably, the raised indicia 37 imprinted on the second path corresponds to the same text or illustrations imprinted on the first path.

As shown in the FIGURE, each of the second path segments comprises an outer border 31, an inner border 32 shared by adjacent first path segments 11, and rearward and forward 33 borders connecting the outer and inner borders of the segments. In certain embodiments, raised indicia 30 may be oriented along at least one of the borders, as well. Preferably, substantially the entire length of the first path is adjacent substantially the entire length of the second path as shown.

Preferably, at least one game piece 50 of the present invention has raised indicia 38 for use by a sight-impaired player. It will be recognized that the game piece may be of any number of different configuration. Moreover, the raised indicia may comprise Braille letters and/or numbers.

The game assembly of the present invention also includes a means for determining where the game pieces should be moved along one of the paths during play of the game. Conventional means include dice 60, 61, a spinner secured to a card having numbers arranged in circular fashion printed thereon, for example (not shown), and a deck of cards (not shown). The dice, spinner card assembly, and deck of cards include raised indicia (e.g. Braille) that can be read by the sight-impaired player. These items may also have text, numbers, and other markings (e.g. dots on the dice) that can be visually observed by the sighted player during play of the game. Alternatively, as shown, separate dice 61, 60, spinner card assemblies, and instructional cards may be used by sighted persons and sight-impaired persons, respectively. Conventional means may also include audio devices and any other electronic devices known by those ordinary skill in the art that may be designed or programmed for conveying random instructions.

The game assembly preferably includes written directions for the play of the game, either on a separate item (e.g. manual, sheet of paper, game box, game board) or on the same item as the written letter/number text for review by the sighted players.

The game board may be fabricated using any number of suitable materials known by those of ordinary skill in the art, including, but not limited to, cardboard, paper, and plastic. It will also be appreciated by those of ordinary skill in the art that the inventive game board assembly may be adapted to play a wide variety of different games. Moreover, the arrangement or configuration of the two elongated paths on the game board may be changed as desired. For example, the FIGURE illustrates a winding, "serpentine" configuration of the two paths; however the paths may also be arranged in a more circular patter or in a straight vertical or horizontal fashion (not shown).

What is claimed is:

1. A game assembly comprising a (a) game board having an upper surface and (b) at least one game piece adapted for movement upon said upper surface of said game board during play of a game, said upper surface of said game board having printed thereon:

(i) a first elongated path divided into a plurality of segments upon which said at least one game piece may be placed and moved during play of said game, said first path having imprinted thereon indicia selected from text and illustrations; and (ii) a second elongated path divided into a plurality of segments upon which said at least one game piece may be placed and moved during said play of said game, said second elongated path positioned parallel and adjacent to said first elongated path such that each of said second path segments are adjacent to one of said first path segments; and wherein at least one of said second path segments has imprinted thereon raised indicia that can be tactilely read by a person having impaired eyesight, said raised indicia corresponding to said indicia imprinted on said first elongated path.

2. The game assembly of claim 1, further including a means for determining where at least one of said game pieces should be moved along one of said elongated paths.

3. The game assembly of claim 1, wherein at least one of said game pieces has raised indicia imprinted thereon.

4. The game assembly of claim 3, further including a means for determining where at least one of said game pieces should be moved along one of said elongated paths.

5. The game assembly of claim 1 wherein each of said second path segments comprises an outer border, an inner border shared by an adjacent first path segment, and rearward and forward borders connecting said outer and inner borders, and wherein said raised indicia is oriented along at least one of said borders.

6. The game assembly of claim 5, wherein at least one of said game pieces has raised indicia imprinted thereon.

7. The game assembly of claim 6, further including a means for determining where at least one of said game pieces should be moved along one of said elongated paths.

8. The game assembly of claim 1, wherein said indicia includes Braille instructions imprinted on at least one of said second path segments.

9. The game assembly of claim 8, wherein at least one of said game pieces has raised indicia imprinted thereon.

10. The game assembly of claim 9, further including a means for determining where at least one of said game pieces should be moved along one of said elongated paths.

* * * * *